313-422 SR
7/27/82 XR 4,341,980

United States Patent [19] [11] 4,341,980
Noguchi et al. [45] Jul. 27, 1982

[54] FLAT DISPLAY DEVICE

[75] Inventors: Mikio Noguchi, Chigasaki; Kazuho Kobayashi, Yokohama; Shigeo Takenaka, Fukaya; Masaru Shimbo, Yokohama, all of Japan

[73] Assignee: Tokyo Shibaura Denki Kabushiki Kaisha, Kawasaki, Japan

[21] Appl. No.: 183,995

[22] Filed: Sep. 4, 1980

[30] Foreign Application Priority Data

Sep. 5, 1979 [JP] Japan ..... 54-112830
Sep. 5, 1979 [JP] Japan ..... 54-112831

[51] Int. Cl.[3] ..... H01J 63/02
[52] U.S. Cl. ..... 315/169.1; 313/409; 313/422; 313/495; 313/477 R
[58] Field of Search ..... 315/98, 167, 169.1, 315/13 R, 366; 313/409, 417, 422, 477 R, 482, 495–497, 318; 340/720

[56] References Cited

U.S. PATENT DOCUMENTS 3,935,500 1/1976 Oess et al. ..... 313/495

OTHER PUBLICATIONS

TI's Flat CRT, Electronics, Oct. 27, 1977, p. 42.

*Primary Examiner*—Eugene R. La Roche
*Attorney, Agent, or Firm*—Cushman, Darby & Cushman

[57] ABSTRACT

A flat display device comprises a vacuum envelope constituted by a back base plate consisting of an elastic metal plate and a display panel and accommodating a thermionic cathode structure and a plurality of electrode structures for controlling the electron beams emitted from the thermionic cathode structure. The thermionic cathode structure is divided into a plurality of sections each including a plurality of coiled thermionic cathode heaters connected in parallel and arranged such that each corresponds to each of picture element regions provided on the back side of the display panel. Voltage supply terminals for supplying power to the parallel coiled heaters in each section are led out through the back base plate via insulating members.

5 Claims, 8 Drawing Figures

FLAT DISPLAY DEVICE

This invention relates to flat display devices and, more particularly, to a flat display device having a thermionic cathode structure including a plurality of thermionic cathodes arranged in a planar array as an electron beam source.

Cathode-ray tubes have hitherto been chiefly used for the display of television pictures and also the display of characters and drawings. This is because of the facts that they are superior in brightness, can quickly respond to signals, are capable of ready scanning for the display and are superior in the resolution of the display picture. However, they have drawbacks in that the depth of the device is large compared to the image display area and that the life of the device is comparatively short.

As receiving tubes were replaced by semiconductor devices, researches and investigations have been made to replace the display devices using semiconductor elements with display devices using cathode-ray tubes. As the flat display device, liquid crystals, electroluminescence phenomenon or plasma discharge display have been developed. Any of these display devices, however, is inferior in the luminescent efficiency of the display surface and in the speed of response to a display device using a cathode-ray tube. Meanwhile, with a trend for the density increase of the information handled by electronic computers there have been increasing demands for improved performance of the display device for displaying such information and also for increase of the display area of the display device.

A flat display device, in which a beam of electrons emitted in vacuum from a flat electron emitting structure is controlled by a combination of voltages supplied to a plurality of flat electrode structures each having a number of electron beam passage holes and then accelerated in a following stage by an accelerating voltage supplied to the following stage for causing fluorescence of a desired picture element region (or merely referred to as picture element) on a fluorescent screen, is disclosed in, for instance, U.S. Pat. Nos. 3,408,532 and 3,935,500. The device disclosed in the U.S. Pat. No. 3,408,532 has a cold cathode electrode excited by a radiant ray reaction or photoelectric effect, and electrons emitted from the cold cathode is amplified through a secondary electron multiplier electrode to obtain a desired electron beam. The reason for adopting this cold cathode as the electron emitting source although it has unknown technical problems is to avoid the temperature rise of the display device due to power consumption. However, since the cold cathode and secondary electron multiplication are required, the realization of a practically feasible flat display device is difficult. The display device disclosed in the aforementioned U.S. Pat. No. 3,935,500 has a flat thermionic cathode structure. In this device, predetermined portions of a tungsten wire heater project in the form of hair pins, and the cathodes are formed in these projected portions. However, since the cathodes are connected in series, the voltage difference between the heater terminals are high, so that a shading pattern is liable to result. In addition, thermal energy of the heater flows through the substrate supporting the heater, so that the conduction loss of energy is high. From this ground, it is difficult to obtain a flat display device having a large area. Further, a deflecting electrode is provided for hair-pin-like point thermionic cathode for scanning a predetermined area of the fluorescent screen.

"IEEE Transactions on Electron Device", Vol. ED-18, No. 9, September 1971, pages 692 to 697, discloses a flat display device having a linear thermionic cathode. In this device, the fluorescence of a number of picture elements is caused by one thermionic cathode, and the voltage difference between the heater terminals is again high.

While the thermionic cathode adopted as electron beam source permits to obtain excellent brightness and high speed response of the display and simple scanning, when constructing a flat display device various problems are involved in the constructions of the thermionic cathode structure and the vacuum envelope. More particularly, regarding the construction of the thermionic cathode structure various problems to be discussed hereinunder are encountered in connection to the reliability, power consumption and method of driving of the display device in which the fluorescence of a plurality of picture elements is caused by one thermionic cathode as in the prior art. Also, when constructing a display device having a large display area, problems are encountered in the construction of the vacuum envelope. Further, where all the thermionic cathodes are connected in parallel for the purpose of improving the reliability and method of driving, problems are encountered in the method of supplying heating power to these thermionic cathodes.

The aforementioned various problems will now be summarized. In the first place, the reliability of the device will be discussed. The display device having a thermionic cathode has the problems of the reduction of the electron emission of the thermionic cathode and the burn-out of the heater constituting the thermionic cathode. The occurrence of the burn-out of the heater is determined by the probability of occurrence of incidental accidents and is inevitable. Where the fluorescence of a plurality of picture elements is caused by a single thermionic cathode, the burn-out of even one thermionic cathode results in the defective display of the display device. In the second place, the power consumption of the display device will be discussed. In the display device using thermionic cathodes, the power consumption by the heaters constituting the thermionic cathodes constitutes a major portion of the total power consumption, and the heat generation due to this power consumption imposes restrictions upon the design of the display device. In the construction where the fluorescence of a plurality of picture elements is caused by a single thermionic cathode, it is necessary to heat even portions that are found between adjacent picture elements, so that the power consumption is increased by that amount. In the third place, problems encountered in the driving of the display device will be discussed. Where the fluorescence of a plurality of picture elements is caused by a single heater, the heater is inevitably long as mentioned earlier. With a long heater, the potential difference between the opposite ends of the heater is correspondingly high. While a voltage based upon the potential on the heater has to be applied to the electrodes for controlling the electron beam emitted from the thermionic electron emitting portion of the heater, where the potential is high as mentioned above it is sometimes necessary to correct the voltage applied to these electrodes, and in such a case various technical problems are encountered. If no correction is made in such a case, the shading pattern arises. Further, in the construction where each thermionic cathode corresponds to a plurality of picture elements, a means for deflecting the electron beam is required. In the fourth place, problems encountered in connection with the mechanical strength of the vacuum tube will be discussed. In the flat display device, the display area has a diagonal length as large as, for instance, 1.2 m. Besides, the depth of the device is very small. The vacuum envelope is formed by vacuum sealing together the display panel and back base plate individually having a large area as mentioned above. If the display panel and back base plate are both made of glass, and also if a glass plate having dimensions of 1 m by 0.75 m is used as the back base plate, this glass plate must have a thickness of at least 10 mm. While glass is very strong with respect to compressive stresses, it is very weak with respect to tensile stresses. When the atmospheric pressure is applied to the vacuum envelope, the glass display panel and glass back base plate share the stress produced so that a balanced state results. However, the stress distribution varies with different portions of the envelope, and also tensile stress and compressive stress always coexist. In this case, the tensile stress is likely to be concentrated in the glass back base plate to cause rapture thereof. In the fifth place, problems encountered in supplying heating power to the thermionic cathode will be discussed. In a flat display device having a large area, in which the heaters are arrange such that each corresponds to each picture element and are all connected in parallel, the current supplied to the heater may be as large as, for instance, 1,000 A. In order to introduce such large current into the vacuum envelope, various technical problems have to be solved.

The invention has for its object to provide a flat display device of a large display area, which has means for solving the aforementioned first to fifth problems.

The flat display device according to the invention comprises a vacuum envelope constituted by a back base plate and a flat display panel provided with an inner fluorescent material layer; a flat thermionic cathode structure disposed at a position separated from the inner side of the back base plate and parallel to the display panel; and a plurality of flat electrode structures stacked together with intervening insulators between the thermionic cathode structure and the fluorescent material layer, the flat electrode structures each having a plurality of thermionic electron beam passage holes. The plurality of flat electrode structures are arranged to control and accelerate thermionic electron beams emitted from the thermionic cathode structure such that these thermionic electron beams strike respective picture element regions predetermined in a regular array on the fluorescent material layer and thus cause fluorescence of the picture element regions. The back base plate is constituted by an elastic metal plate. The hot cathode structure comprises a plurality of sections each including a plurality of coiled heaters each having an effective thermionic electron emitting portion having a coating of a thermionic electron emitting material. The individual effective thermionic electron emitting portions are arranged such that each corresponds to each of the picture element regions. The coiled heaters have portions thereof other than the effective thermionic electron emitting portions supported by a plurality of conductive support members such that the effective thermionic electron emitting portions are held in space. The plurality of conductive support members are connected to a plurality of voltage supply terminals for supplying heating power to all the coiled heaters connected in parallel. The plurality of voltage supply terminals are led out through the back base plate via insulating members. The thermionic electron beam passage holes formed in each of the flat electrode structures are arranged such that each corresponds to each of the effective thermionic electron emitting portions.

This invention can be more fully understood from the following detailed description when taken in conjunction with the accompanying drawings, in which.

Figure 1:
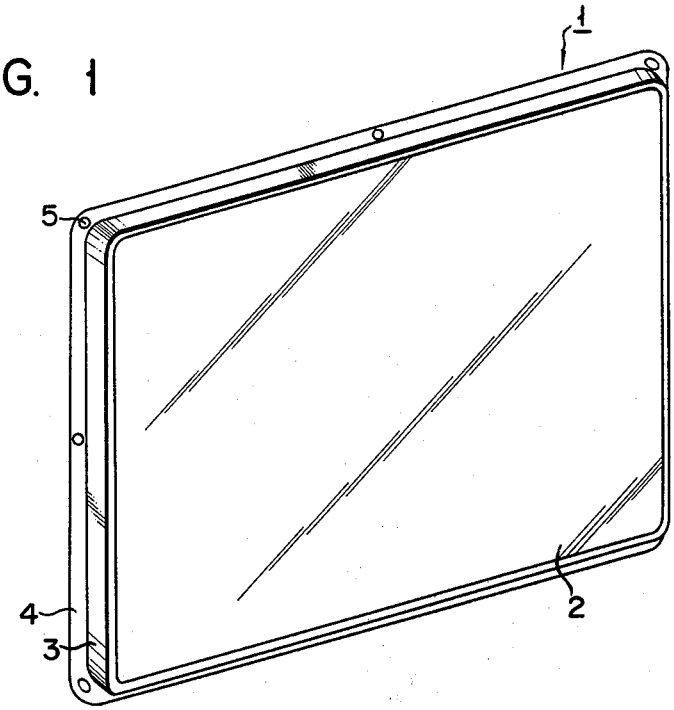
FIG. 1 is a perspective view showing a display device according to the invention.
Figure 2:
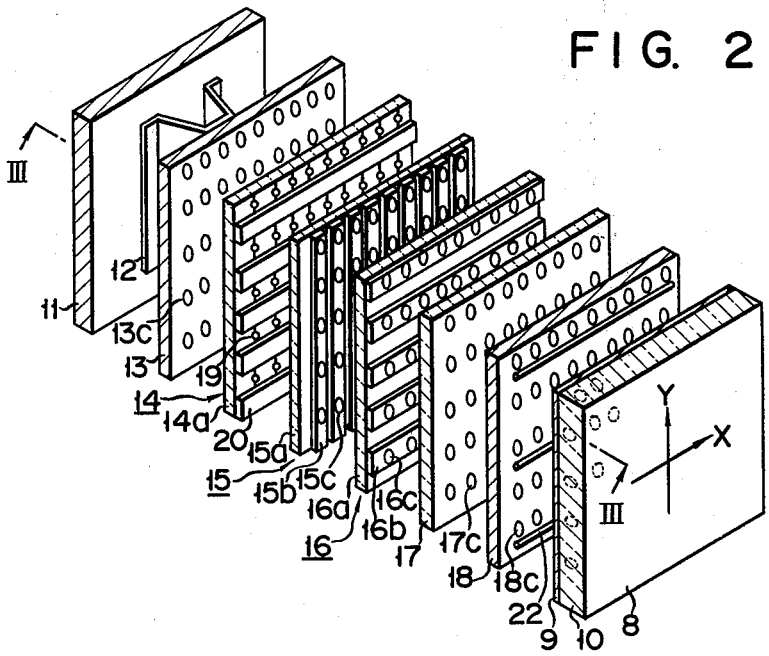
FIG. 2 is a fragmentary exploded perspective view showing the inner construction of the device shown in FIG. 1, with a thermionic cathode structure, control electrode structures and a display panel being shown separated from one another.

Now, an embodiment of the invention will be described with reference to the accompanying drawings. FIG. 1 shows a perspective view of a flat display device 1 embodying the invention, with control devices connected to the outside of its vacuum envelope being omitted. Its display panel is provided with an outer protective plate 2 which is a transparent plastic plate or a glass plate. The protective plate 2 is provided around its edges with a support frame 3 and a flange 4. The flange is formed with holes 5 for mounting the display device. FIG. 2 shows the internal construction of the display device shown in FIG. 1.

Referring to FIG. 2, the display panel, designated at 8, for instance made of transparent glass, is provided with an inner fluorescent material layer 9. The fluorescent material layer 9 contains portions 10 used as picture element regions (hereinafter referred to as picture elements). These picture elements 10 are arranged in a matrix array. X and Y directions are shown on the display panel 8 for the sake of the convenience of the description. A back base plate 11 made of an elastic metal plate is provided to face the display panel 8. The edges of the back base plate 11 and display panel 8 are sealed with a well-known means to form a vacuum envelope. A metal spacer 12, a first support plate 13 made of a metal, a thermionic cathode structure 14, a first electrode structure 15, a second electrode structure 16, a second support plate 17 made of an insulating material such as glass, a third electrode structure 18 consisting of a metal plate and insulating spacers 22 secured to the third electrode structure are arranged in the mentioned order between the back base plate 11 and fluorescent material layer 9 from the side of the back base plate 11. The component parts 12 to 18, 22 and 9 are held in close contact with one another within the vacuum envelope which is highly evacuated and are urged against the back base plate 11 with a suitable pressure provided by an external force.

Figure 6:
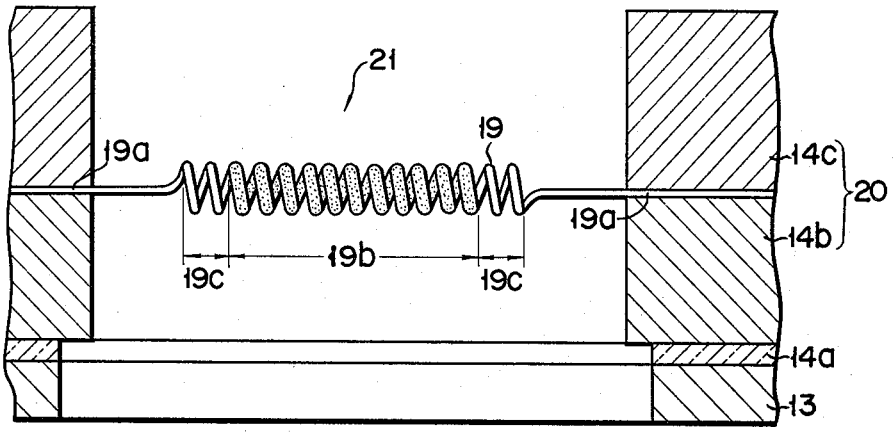
FIG. 6 is a fragmentary enlarged-scale sectional view showing the relation between a coiled heater in the thermionic cathode structure of the FIG. 1 device and support members supporting the coiled heater.

As is shown in FIG. 6, the thermionic cathode structure 14 includes an insulating plate 14*a* supported on the first support plate 13, first and second conductive support members 14*b* and 14*c* secured to the insulating plate 14*a* and coiled heaters 19. Of the first and second support members 14*b* and 14*c* at least either one must be conductive, but in the instant embodiment both of them are conductive. In FIG. 2, both of them are generally designated by reference numeral 20. These support members 20 serve to support predetermined portions 19*a* of the individual coil heaters 19 in the conductive relation thereto and supply power to the heaters 19 for heating them. In FIG. 2, the support members 20 extend in the X direction, and the individual coiled heaters 19 are each supported in each specific space 21. The coiled heaters are coated with a thermionic electron emitting material, and the portion of the heater on which the termionic electron emitting material is coated is designated by reference symbol 19*b* (FIG. 6). The individual coiled heaters 19 are provided such that each of them corresponds to each of the picture elements 10 (FIG. 2), and they are all connected in parallel to one another to a heating power source (not shown) through the support member 20.

Figure 3:
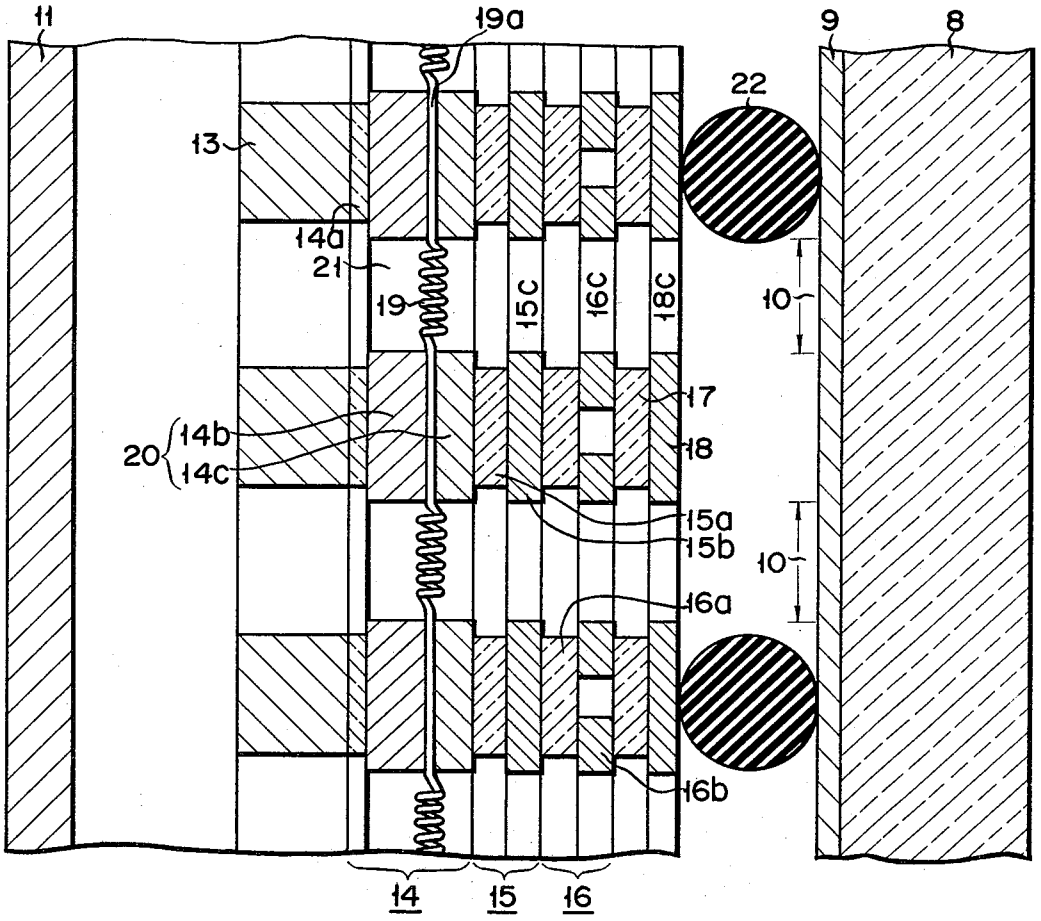
FIG. 3 is a fragmentary enlarged-scale sectional view of the device taken along line III—III extending in the Y direction in FIG. 2 and viewed in the direction of arrows.

The first electrode structure 15 includes a plurality of first electrodes 15*b* secured to an insulating plate 15*a* of glass or the like and extending in the Y direction. The first electrodes 15*b* are each provided with thermionic electron beam passage holes 15*c*. Of course, the insulating plate 15*a* are formed with holes corresponding to the holes 15*c*. The second electrode structure 16 includes an insulating plate 16*a* and second electrodes 16*b* secured to the insulating plate 16*a*, for instance made of glass, and extending in the X direction. The second electrodes 16*b* are each provided with thermionic electron beam passage holes 16*c*, and the insulating plate 16*a* is formed at positions corresponding to the holes 16*c* with respective holes. The second insulating support plate 17 is provided with thermionic electron beam passage holes 17*c*. The third electrode structure 18 consists of a single metal plate formed with thermionic electron beam passage holes 18*c*. The first support plate 13 is formed with holes 13*c*, which have the role of heat radiation. FIG. 3 is a section taken along line III—III extending in the Y direction in FIG. 2 and viewed in the direction of arrows, and it shows the positional relation among the elastic metal plate 11, first support plate 13, thermionic cathode structure 14, first electrode structure 15, second electrode structure 16, second support plate 17, third electrode structure 18, spacers 22 and fluorescent material layer 9. As is apparent from FIG. 3, the coiled heaters 19 are each provided to correspond to each of picture element regions (picture elements) 10 provided at respective predetermined positions in the fluorescent material layer 9, and the thermionic electron beam passage holes 15*c*, 16*c* and 18*c* are also provided such that each corresponds to each picture element. A metal back layer (not shown) may, if necessary, be provided on the fluorescent material layer 9. Terminals for supplying power to the coiled heaters 19 penetrate the elastic metal plate 11 in a state insulated therefrom by insulating members as will be described later in detail and extends to the outside of the vacuum envelope. Conductors for supplying signals to the individual electrode structures are led out through the sealed portion between the back base plate 11 and display panel 8 or, if necessary, led out through the back base plate 11 via an insulating material.

Figure 5:
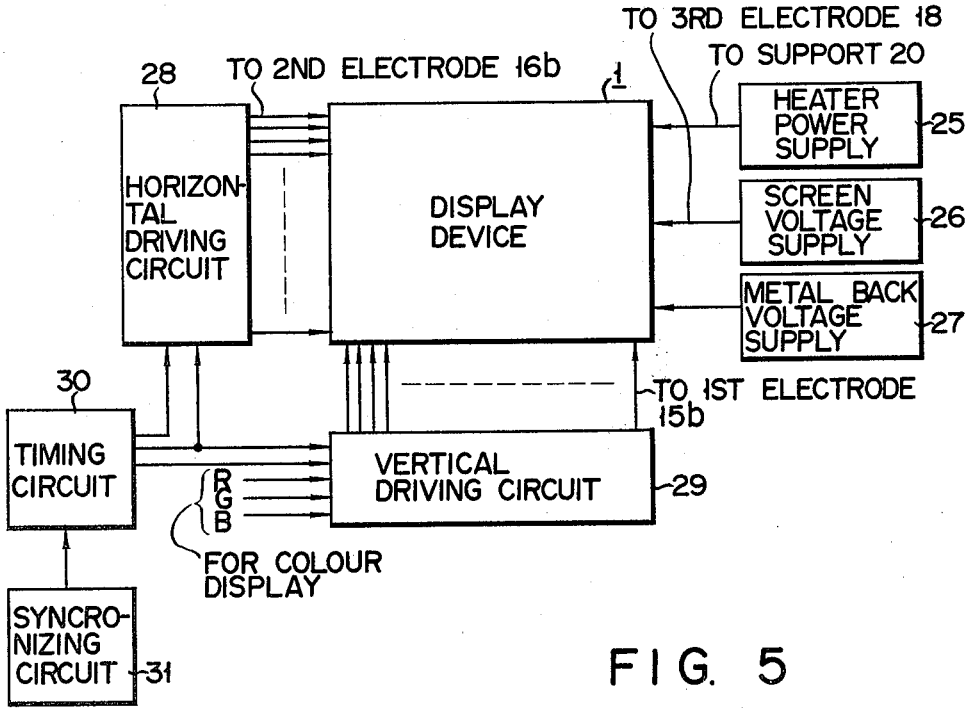
FIG. 5 is a block diagram showing the state of connection of external control circuits to the FIG. 1 device.

FIG. 5 shows external circuits connected to the display device 1. A heater power supply 25 supplies power to the support members 20. The terminal voltage across the coiled heaters 19 is about 0.5 V. To the third electrode (i.e., the third electrode structure 18) about 100 V is supplied as screen voltage from a screen voltage supply 26. To the metal back layer (not shown) a voltage of about 5 kV is supplied, if necessary, from a metal back voltage supply 27. A signal for selecting a picture element in the horizontal direction (X-direction driving signal) is supplied from a horizontal driving circuit 28 to the second electrode 16*b*, and a signal for selecting a picture element in the vertical direction (Y-direction driving signal) is supplied from a vertical driving circuit 29 to the first electrode 15*b*. To the circuits 28 and 29 are supplied timing signals from a timing circuit 30, which is controlled by a synchronizing circuit 31.

The coiled heater 19 will now be described. It is formed from a very thin wire having a low thermal conductivity. Its material is preferably W (tungsten), W-alloys, Ni-W alloys, etc. The wire diameter varies with the size of the display device, but it practically ranges from 0.3 to 5 $\mu m\phi$. Regarding the number of picture elements 10, it is 250 KP (KP=1,000) in the case of the monochrome display and is 750 KP in the case of the color display. With a display device with a diagonal length of 1.2 M and a picture element number of 750 KP, assuming the power consumption of the thermionic cathode structure 14 is 500 W, one coiled heater 19 consumes power of about 0.6 mW. In a design example of the coiled heater 19 using Ni-W alloy, the metal wire diameter is 2.6 $\mu m\phi$, the outer diameter of the coil is 20 $\mu$m, the coil length is 0.3 mm, the extended coil length is 2.5 mm, and the thermionic electron current, assuming the effective thermionic electron emitting portion with a surface area of, for instance, $5\times10^{-5}$ cm$^2$, is 30 $\mu$A. Where such coiled heaters are all connected in parallel, the heating current supplied reaches as large as about 1,000 A. If the hot cathode structure 14 is divided into 25 sections, only 40 A of heating current may be supplied to each section. With the device according to the invention, the back base plate 11 consists of an elastic metal plate (with a thickness of 1 to 2 mm), so that a number of heating current supply terminals can be easily led out through this back base plate 11. While the illustrated back base plate consisting of the elastic metal plate is a flat metal plate, it is also possible to use a dish-like metal plate. In this case, the bottom of the dish-like plate may be directed toward the display panel or in the opposite direction. The method of dividing the thermionic cathode structure 14 and the method of leading the heating current supply terminals to the individual sections of the thermionic cathode structure will now be described with reference to FIGS. 4, 7 and 8. For the sake of the simplicity of the description, a case of dividing the thermionic cathode structure into four sections will be taken.

Figure 4:
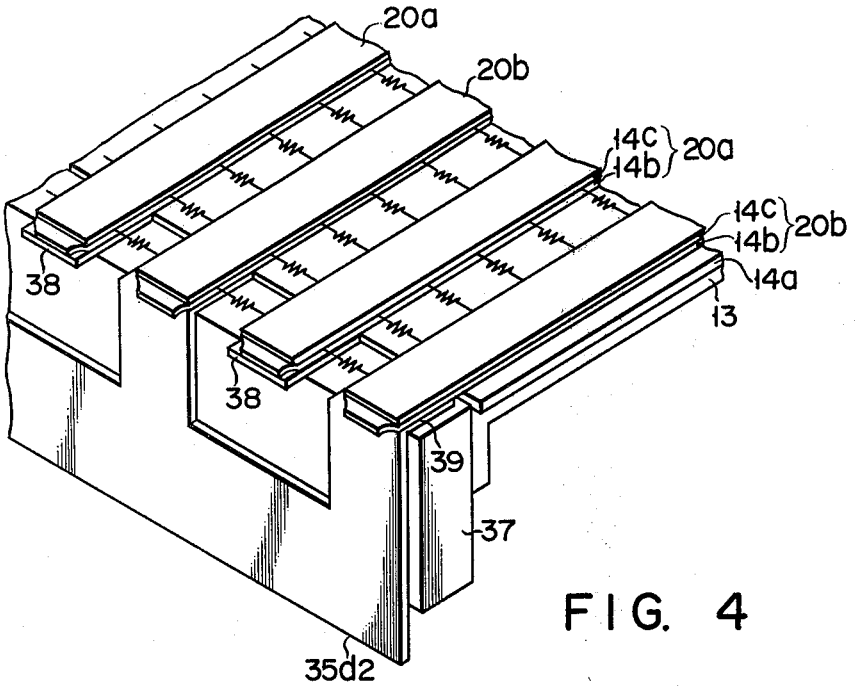
FIG. 4 is a fragmentary enlarged-scale perspective view showing the thermionic cathode structure of FIG. 2.
Figure 7:
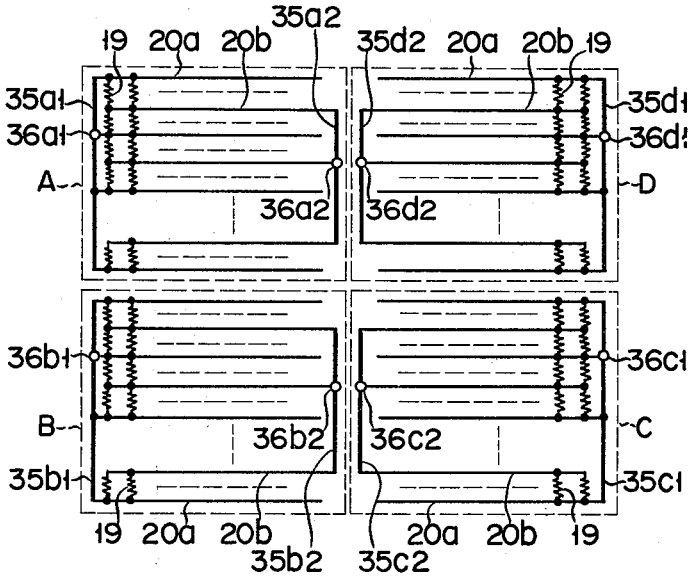
FIG. 7 is a view showing the connection relation between coiled heaters and support members in case where the thermionic cathode structure shown in FIG. 2 consists of four divisions.

In FIG. 7, the thermionic cathode structure 14 consists of first, second, third and fourth sections or divisions A, B, C and D. In the section A, a current distribution conductor 35*a*1 is arranged on the left side, and a current distribution conductor 35*a*2 is arranged on the right side. Conductive support members 20*a* are connected to the conductor 35*a*1, and conductive support members 20*b* are connected to the conductor 35*a*2. These support members 20*a* and 20*b* are arranged such that the former members each extend between adjacent latter members and vice versa. The coiled heaters are each connected between adjacent support members 20*a* and 20*b*. Thus, by connecting a voltage supply terminal 36*a*1 connected to the conductor 35*a*1 to the positive terminal of the heater power supply and connecting a voltage supply terminal 36*a*2 connected to the conductor 35*a*2 to the negative supply terminal of the power supply, all the coiled heaters 19 in the section A can be connected in parallel to the power supply. The sections B, C and D have the same construction as the section A, so like parts are designated by like reference numerals and their description is omitted. The construction of these sections, for instance section D, will now be described in further detail with reference to FIG. 4. In FIG. 4, the first support plate 13 and insulating plate 14*a* shown in FIG. 2 are each shown to consist of four divisions. An insulating member 37 is secured in a state clamped between a bent portion of the first support plate 13 and the current distribution conductor 35*d*2. The current distribution conductor 35*d*2 has a plurality of bent portions 39 which are secured to the top of the insulating member 37. The support members 20*a* and 20*b* are arranged alternately and parallel to one another. Each support member 20*b* is secured to the insulating plate 14*a* and each bent portion 39 and extends in the X direction (FIG. 2). Each support member 20*a* is secured to the insulating plate 14*a* and a spacer 38 provided on top of the insulating member 37 and also extends in the X direction. At the other ends of the support members 20*a* and 20*b*, the current distribution conductor 35*d*1 (FIG. 7), an insulating member 37 (not shown) and a spacer 38 (not shown) are provided. The other end of each support member 20*a* is electrically connected to the current distribution conductor 35*d*1, but the other end of each support member 20*b* is electrically insulated from the current distribution conductor 35*d*1. The current distribution conductors 35*d*1 and 35*d*2 are connected through flexible conductors to respective voltage supply terminals (not shown), which are led out through the elastic metal plate 11 via an insulator to the outside. In the above construction, current supply terminals corresponding in number to double the number of sections of the thermionic cathode structure, namely eight current supply terminals in this embodiment, are led out to the outside. However, it is possible to take out a current supply terminal which is common to two sections as shown in FIG. 8.

Figure 8:
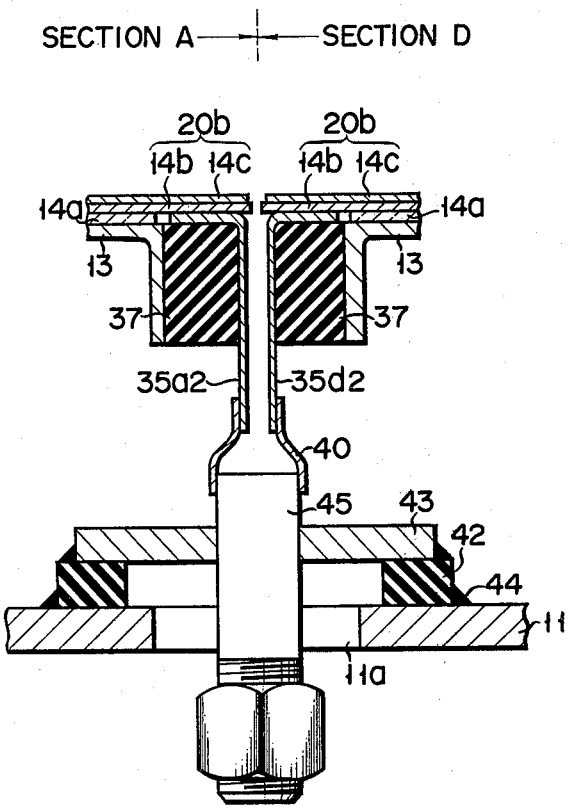
FIG. 8 is a sectional view showing an example of the connection of voltage supply terminals for supplying power to the conductive support members in the thermionic cathode structure sections in FIG. 7.

In FIG. 8, the current distribution conductor 35*a*2 in the section A and the current distribution conductor 35*d*2 in the section D are connected by respective ribbon-like flexible conductors 40 to a voltage supply terminal 45. A ceramic ring 42 is hermetically secured by silver solder 44 to a portion of the elastic metal plate 11 surrounding a terminal take-out hole 11*a*, and a metal disc 43 is hermetically secured to the ceramic ring. A voltage supply terminal 45 hermetically penetrates the metal plate 43 and is led out to the outside of the back base plate 11. This method of taking out voltage supply terminals can be adopted if necessary, and it permits to make the number of voltage supply terminals to be less than twice the number of sections.

As is apparent from FIG. 4, the first support member 13 is divided into a plurality of sections when dividing the thermionic cathode structure 14 into the corresponding number of sections. In this case, it is also possible to divide the other electrode structures 15, 16 and 18 and the second support plate 17 into a plurality of sections. The main purpose of dividing the above parts into a plurality of sections is to prevent insufficient brightness in part of the display screen, which may otherwise result when the thermionic electron passage holes in the electrode structures get out of their regular positions corresponding to the respective picture elements due to thermal expansion of the electrode structures caused by heat generated from the thermionic cathode structure. Another purpose is to prevent rapture of the display device due to the aforementioned thermal expansion. When dividing the structures into a plurality of sections, it is necessary to provide a sufficient space between adjacent sections to permit compensation for the thermal expansion and connect together the individual sections with flexible members. Further, where the characteristics (for instance brightness) vary with the individual sections, it is possible to separately take out conductors from the individual sections such that voltages applied to the individual sections can be appropriately corrected and apply different voltages to these conductors so as to display with uniform brightness over the whole screen. A further reason for dividing the thermionic cathode and other electrode structures into a plurality of sections is that by so doing the manufacture of the display device can be facilitated. More particularly, in the manufacture of a display device having a large display area, undesired faulty portions are likely to result in the process of fabrication of the electrode structure. In such a case, by constructing the electrode structure from a plurality of sections it is possible to omit defective sections, so that a flat display device having a large display area can be comparatively easily manufactured.

The operation and effects of the device according to the invention will now be described. The reliability of the display device will first be discussed. According to the invention, the thermionic cathodes are provided such that each of them corresponds to each picture element. In the probability point of view, the burn-out of some of the heaters constituting the hot cathode is inevitable. However, since according to the invention all the coiled heaters are connected in parallel between the voltage supply terminals, even if some heaters are burnt out, the corresponding defects of display are distributed over the entire screen in the probability point of view so that they are not recognizable. On the other hand, where heaters are provided each for a plurality of picture elements, the burn-out of even a single heater results in the display defect of a plurality of picture elements provided in succession, that is, even with the burn-out of a single heater a recognizable display defect results. From the above ground, according to the invention it is possible to improve the reliability of the display device. In the second place, according to the invention it is possible to provide a display device of low power consumption. With the construction in which coiled heaters are arranged such that each of them corresponds to each picture element, power supplied to the heater for heating tends to be large. However, since according to the invention coiled heaters are adopted and their effective thermionic electron emitting portions is operated at a comparatively low temperature, the power consumption of the effective thermionic electron emitting portion itself can be made to be comparatively low. In addition, portions of the heater other than the effective thermionic electron emitting portion are supported by conductive support members 20 of a low resistance as shown in FIG. 6. Thus, it is possible to minimize the power loss in the current path to the effective thermionic electron emitting portion. Further, since the effective thermionic electron emitting portion 19*b* is supported in a space 21 in vacuum, the power loss resulting from the heat conduction can be reduced. Thus, this construction permits arrangement of heaters such that each of them corresponds to each picture element. In the third place, the driving of the display device is simplified. With the arrangement of the heaters each corresponding to each picture element, no deflection of the thermionic electron beam is required. In addition, since the heaters are all connected in parallel, the potential difference between the opposite ends of the heater is, for instance, 0.5 V. Thus, there is no need of correcting the voltage for controlling the thermionic electron beam for different points on the display screen of the display device. In the fourth place, since an elastic metal plate is used as the back base plate 11, it is possible to absorb the stress produced in the display panel 8 (which is made of glass) and thus prevent rapture thereof. Thus, the thickness of the display panel can be reduced to a desired and sufficient value. In addition, a number of voltage supply terminals for supplying power to the thermionic cathode structure 14 for heating the heaters can be simply taken out from the back base plate 11. Further, with the back base plate 11 consisting of the elastic metal plate the stress produced in it due to the installation of a number of voltage supply terminals can be absorbed by itself, so that no dangerous stress is produced in the display panel 8. Furthermore, the hot cathode and electrode structures can be held in a predetermined positional relations to one another by applying suitable pressures to these structures. In the fifth place, since the thermionic cathode structure 14 is divided into a plurality of sections which are provided with respective voltage supply terminals, it is possible to easily supply heating power to all the coil heaters connected in parallel to one another. In addition, appropriate compensation for the thermal expansion of the thermionic cathode structure can be readily made. With the above first to fifth features combined it is possible to provide a flat display device having a large display area.

What we claim is:

1. A flat display device comprising:

a vacuum envelope constituted by a back base plate and a flat display panel provided with an inner fluorescent material layer;

a flat thermionic cathode structure disposed at a position separated from the inner side of said back base plate and parallel to said display panel; and a plurality of flat electrode structures stacked together with intervening insulators between said thermionic cathode structure and said fluorescent material layer, said flat electrode structures each having a plurality of thermionic electron beam passage holes;

said plurality of flat electrode structures being arranged to control and accelerate thermionic electron beams emitted from said thermionic cathode structure such that said thermionic electron beams strike respective picture element regions predetermined in a regular array on said fluorescent material layer and thus cause fluorescence of said picture element regions;

said back base plate being constituted by an elastic metal plate;

said thermionic cathode structure comprising a plurality of sections, said sections each including a plurality of coiled heaters, said coiled heaters each having an effective thermionic electron emitting portion having a coating of a thermionic electron emitting material, said individual effective thermionic electron emitting portions being arranged such that each corresponds to each of said picture element regions, said coiled heaters having portions thereof other than said effective thermionic electron emitting portions supported by a plurality of conductive support members such that said effective thermionic electron emitting portions are held in space, said plurality of conductive support members being connected to a plurality of voltage supply terminals for supplying heating power to all said coiled heaters connected in parallel, and said plurality of voltage supply terminals being led out through said back base plate via insulating members; and said thermionic electron beam passage holes formed in each said flat electrode structures being arranged such that each corresponds to each of said effective thermionic electron emitting portions.

2. A flat display device according to claim 1, wherein said elastic metal plate has a flat shape or a dish-like shape.

3. A flat display device according to claim 1, wherein said thermionic cathode structure is urged against the inner surface of said back base plate via at least one spacer, a metal support plate and an insulating plate.

4. A flat display device according to claim 1 wherein said plurality of electrode structures include first, second and third electrode structures arranged from the side of said thermionic cathode structure to the side of said display panel, said first electrode structure have a plurality of first electrodes extending parallel to said display panel and in either X or Y direction thereof, said thermionic electron beam passage holes are formed in said first electrodes, said second electrode structure have a plurality of second electrodes extending parallel to said display panel and in a direction at right angles to said first electrodes, said thermionic electron beam passage holes are formed in said second electrodes, and said third electrode structure consists of a single electrode member having said thermionic electron beam passage holes.

5. A flat display device according to claim 4, wherein a signal for selecting a picture element arranged in the X or Y direction of said display panel is applied to said first electrodes, a signal for selecting a picture element arranged in the Y or X direction of said display panel is applied to said second electrodes, and a voltage for accelerating thermionic electrons emitted from a thermionic cathode corresponding to the selected picture element is applied to said third electrode structure.

* * * * *